US005275034A

United States Patent [19]

Del Fabro et al.

[11] Patent Number: 5,275,034

[45] Date of Patent: Jan. 4, 1994

[54] MULTIPURPOSE DEVICE FOR ROLLS OF ROUND BARS OF REINFORCED CONCRETE

[75] Inventors: Giorgio Del Fabro, Cassacco-Fraz.Montegnacco; Ercole Masera, Roveredo in Piano, both of Italy

[73] Assignee: M.E.P. Macchine Elettroniche Piegatrici SpA, Reana del Royale, Italy

[21] Appl. No.: 945,873

[22] Filed: Sep. 17, 1992

[30] Foreign Application Priority Data

Oct. 15, 1991 [IT] Italy ..... UD91 A 000170

[51] Int. Cl.[5] ..... B21F 1/02

[52] U.S. Cl. ..... 72/160; 72/183; 242/80; 242/131

[58] Field of Search ..... 72/160, 161, 183, 226; 242/80, 64, 131; 140/147

[56] References Cited

U.S. PATENT DOCUMENTS

| | | | |
|---|---|---|---|
| 586,331 | 7/1897 | Dederick | 140/147 |
| 3,441,234 | 4/1969 | Barten | 242/80 |
| 4,048,825 | 9/1977 | Dastrup et al. | 71/12 |

FOREIGN PATENT DOCUMENTS

| | | | |
|---|---|---|---|
| 0143960 | 6/1985 | European Pat. Off. . | |
| 0269157 | 11/1987 | European Pat. Off. . | |
| 13661 | 6/1881 | Fed. Rep. of Germany | 242/80 |
| 46636 | 4/1889 | Fed. Rep. of Germany | 242/80 |
| 218594 | 2/1972 | France . | |
| 1075789 | 10/1964 | United Kingdom | 72/183 |

*Primary Examiner*—Daniel C. Crane

*Attorney, Agent, or Firm*—Antonelli, Terry, Stout & Kraus

[57] ABSTRACT

Multipurpose device for rolls of sections which are advantageously round bars in rolls for reinforced concrete, the device comprising a rotary turret winder (25) able to bear rolls (17) of sections produced with a hot cold process and including a rotary support (11) having its axis of rotation (12) substantially vertical and supporting along a circumference at least two roll-holder reels (13) with their axes of rotation substantially parallel to the axis of rotation (12) of the rotary support (11), each roll-holder reel (13) cooperating with a specific upright (20), at least one straightening assembly (21) being comprised in cooperation with each single upright (20) of each single reel (13) and being positioned substantially on the same axis as the axis of use of the machine downstream.

7 Claims, 2 Drawing Sheets

MULTIPURPOSE DEVICE FOR ROLLS OF ROUND BARS OF REINFORCED CONCRETE

BACKGROUND OF THE INVENTION

This invention concerns a multipurpose device for rolls of round bars for reinforced concrete.

To be more exact, the invention concerns a multipurpose device for rolls of round bars used for reinforced concrete, the device being located upstream of machines which process the round bars, such as straightening machines, shears for shearing to size, shaping machines, forming machines, etc.

These machines which process the round bars may carry out one or more of the operations of straightening, measuring, shearing and/or bending according to requirements.

This description speaks of sections as round bars, preferably round bars produced with a hot or cold process for use in reinforced concrete, but the invention is also applied properly to sections having different cross sections such as square, hexagonal, polygonal, etc. cross sections and used also for other purposes.

Document IT 83347 A/90 (EP-A-91102615.1) describes a rotary turret winder for rolls of round bars for reinforced concrete, the winder being located upstream of a user machine such as a straightening machine, shears and/or bending/shaping machine.

The above rotary winder comprises at least two roll-holder reels, and when the round bar being processed has to be replaced, for a change of size for instance, the rotary winder has to be rotated to bring the new roll-holder reel to the working position.

The rotary winder of the state of the art is associated with one single machine of the above described type or with one single assembly of machines positioned in series.

The work of replacing the round bar by means of the rotary winder of the state of the art entails a long non-productive time spent in changing the roll or changing the size since on each occasion it is necessary to withdraw/thread the round bar from/into the straightening assembly located outside the rotary winder.

Moreover, the above rotary winder of the state of the art cooperates downstream with a straightening assembly which has of necessity to be complex so as to be able to perform the straightening of coils which have a curvature, due to being wound up, on the plane on which they lie and also have a deformation by twisting due to their being unwound and drawn.

GB-A-1,075,789 of 1964 discloses a turntable device located in a rolling line producing coils. This device has the purpose of winding and unwinding coils in concentric spirals and may cause the coils to pass through a straightening assembly during winding and unwinding. This teaching dating back to 1964 has never met with acceptance in devices which unwind round bars for building work either because it belongs to an old technology or because people have never understood that pre-straightening or straightening of round bars for building work can be carried on during unwinding from a roll of coils in bulk, this too although there has been felt for a long time a need to supply to the working machines immediately downstream a round bar already straightened when it comes off a roll. Moreover, the uniform and expected winding and unwinding of the spirals of the coils cause no difficulty for the straightening assembly.

FR-A-2.182.594 of 1972 discloses a rotary winder bearing two or more rolls of wire, which is wound in coils substantially in bulk. This teaching was disclosed a good eight years later than GB-A-1,075,789 and a good twenty years earlier than the present application. The prestraightening system is the classic one which has been retained up to the present time with central extraction from above, which is not suitable to feed usage machines such as straightening machines, shears and/or bending/shaping machines. The content of FR-A-2.182.594 is unsuitable for installation of straightening assemblies, precisely because of the axial outlet system which is connected to the deviation wheel.

It should also be borne in mind that the devices disclosed in the state of the art documents can work, during unrolling, with one single downstream machine, a four-high rolling mill stand or a drawbench respectively. Furthermore, none of the teaching of the prior art teaches the overcoming of the typical problems of introduction into the machines downstream.

Furthermore, none of the devices of the state of the art provides the ability to process a wide range of different sizes or to supply different machines or machines performing different functions at one and the same time.

SUMMARY OF THE INVENTION

The present applicants have designed, tested and embodied this invention to obviate the shortcomings of the state of the art and to achieve further advantages.

This invention consists in providing a multipurpose device for unwinding rolls of round bars intended for reinforced concrete, the device being suitable to be coupled immediately upstream with a differing plurality of machines, working even at the same time, for the processing of round bars.

The device of this invention is characterized in that it can supply round bars already straightened and possibly sheared to size and thus eliminates the problems of insertion and replacement, the problems of fixation of twists and the problems of feeding different machines at one and the same time.

For this reason the device according to the invention 8 enables a considerable saving of time and shorter cycle times to be achieved, increases the functioning capacity of the rotary winder and may simplify the machines downstream if indeed it does not eliminate them.

According to the invention a support able to rotate about a substantially vertical axis is included. This rotary support holds at least two reels, which are positioned along a circumference having as its generating centre the axis of rotation of the rotary support and have their axes substantially parallel to the axis of the rotary support.

A straightening assembly, within which the relative round bar passes and is therefore always inserted, is included in correspondence with each reel installed rigidly on the rotary support.

Thus, the round bar leaving the device according to the invention is never removed from the straightening assembly, and this situation facilitates start-up and the insertion of the round bar in the machines downstream.

According to a variant a shearing system that cooperates with the straightening assembly is comprised downstream of the straightening assembly.

According to a further variant a system to measure the length of the round bar passing through is associated with the shearing system or with the straightening assembly.

In this way the device according to the invention provides the ability to process even two or more different sizes of round bars at the same time by making use of one or more different machines or equipment at the same time.

Coordination is provided advantageously between a usage means and the device according to this invention by employing suitable data processing units which can process the details of customers' orders already stored in the computer.

The multipurpose device of this invention in its most complete form is a machine on its own with which there can possibly be combined discharging and packaging equipment or bending and shaping equipment or other machines or devices.

The device according to the invention enables simplified straightening assemblies to be employed as the latter have only to straighten the coils in the direction of their curvature on their plane, since in fact the deformation by twisting due to the step of unwinding and vertical displacement of the coils is lacking.

BRIEF DESCRIPTION OF THE DRAWINGS

The attached figures, which are given as a non-restrictive example, show a preferred embodiment of the invention as follows.

DETAILED DESCRIPTION OF THE PREFERRED EMBODIMENTS

Figure 1:
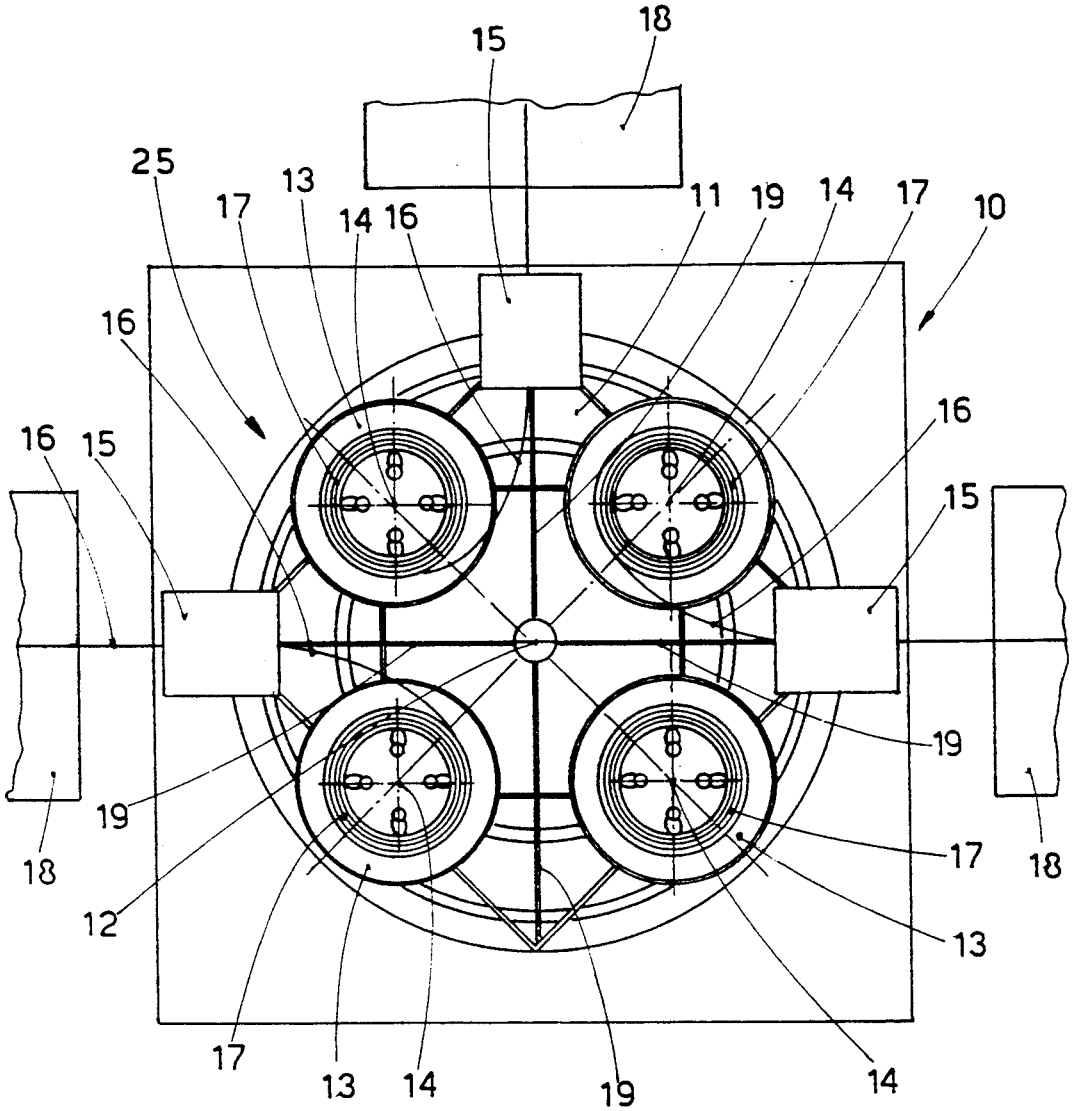
FIG. 1 shows a plan view of a multipurpose device for rolls of round bars according to the invention.

In the figures the reference number 10 indicates a multipurpose device for rolls of round bars according to the invention.

The device 10 of the invention consists of a rotary turret winder 25 which comprises a support 11 able to rotate about a vertical axis 12.

In the embodiment shown the rotary turret winder 25 according to the invention includes four roll-holder reels 13 secured to the rotary support 11, which can rotate in a controlled manner, being driven by suitable drive means, which are not shown here.

The roll-holder reels 13 are positioned along a circumference the generating centre of which is the axis 12 of rotation of the rotary support 11. The roll-holder reels 13 have their axes 14 parallel to the vertical axis 12 of the support 11.

According to the invention supporting elements 15 rigidly fixed to the rotary support 11, by uprights 20 in this example, are included, each one of them cooperating with one of the roll-holder reels 13.

Figure 2:
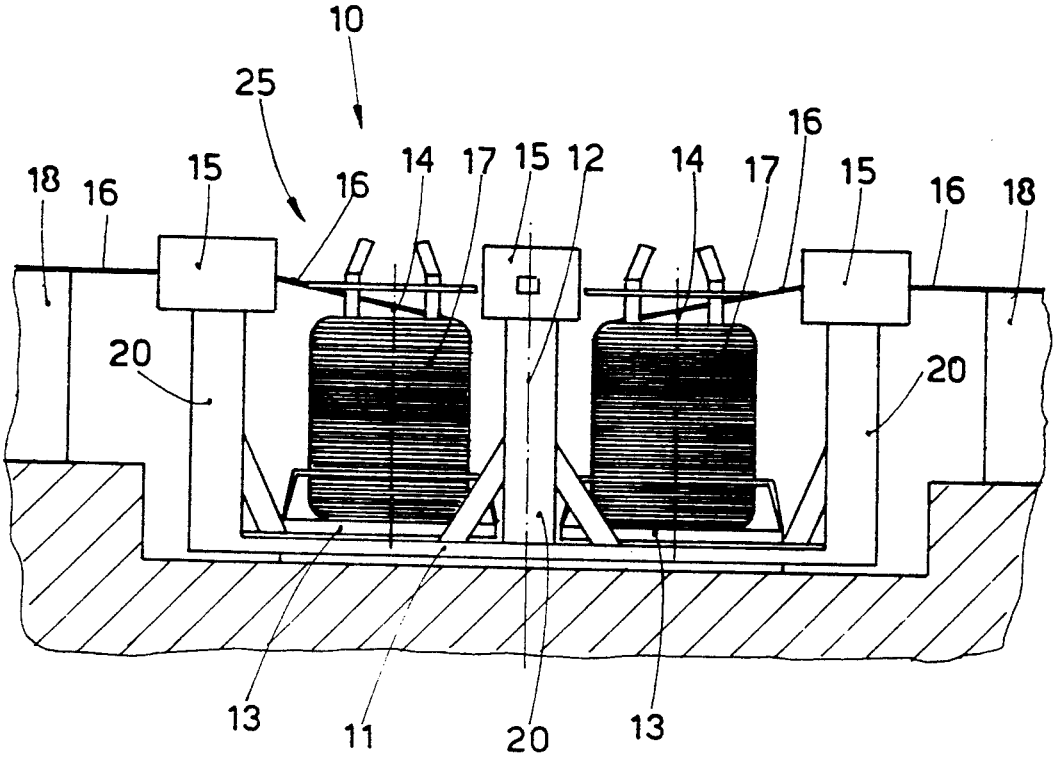
FIG. 2 is a side view of the device of FIG. 1.

These supporting elements 15 are located in an outward position in relation to the position of the roll 17 on the rotary support 11; this compels a round bar 16 to follow a path of tangential unrolling which induces in that round bar 16 a lateral displacement including a slight upward component so as to assist the detachment of the round bar 16 from its relative roll 17 (see FIG. 2).

The supporting elements 15 comprise a straightening assembly 21 (see FIG. 3), which straightens the round bar 16 unwound from its relative roll 17.

In this example a shearing assembly 22 (see FIG. 3) that cooperates with the straightening assembly 21 is included downstream of the straightening assembly 21.

Figure 3:
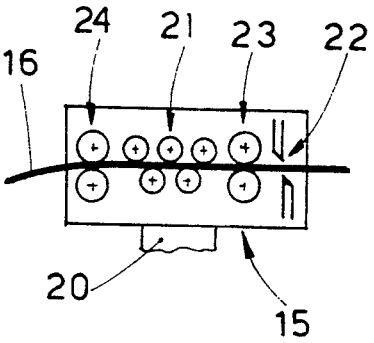
FIG. 3 is a diagram of a support element according to the invention.

According to a variant shown in FIG. 3 an assembly 23 which performs linearization and measurement and which measures the length of, and makes linear, the round bar 16 passing through is associated with the shearing assembly 22 and straightening assembly 21.

According to a further variant a drawing assembly 24 to feed the round bar 16 is associated with the straightening assembly 21.

The device 10 according to the invention can be considered as being a machine on its own, with which there may possibly be combined, in correspondence with each roll-holder reel 13, discharging and packaging equipment 18 or bending and shaping machines or other machines and devices.

In this example three rolls 17 being processed are included which cooperate with three respective supporting elements 15 at work, whereas one side of the device 10 according to the invention is used only as a station for changing rolls 17.

A brake device, which is not shown here, is actuated in the roll-holder reels 13 at work and is synchronized with the relative equipment or machine 18 and possibly with a start-up and/or drive means so as to assist unwinding of the roll 17 in the event of a high unwinding speed.

The drive of the roll-holder reel 13 can also be provided with an inverted movement and can therefore be employed to withdraw a round bar 16 still remaining in the relative machine 18.

The axis of processing of the machine 18 coincides substantially with the axis of the straightening assembly 21.

Such inversion of the round bar can be controlled automatically so that the round bar 16 will remain, in any event, protruding from the supporting element 15 by a required length so as to be able to be re-engaged in a subsequent step by a means for re-insertion in the relative machine 18 or by the machine operator for a manual step.

Coordination is provided advantageously between a downstream usage means and the device 10 according to the invention by employing suitable data processing assemblies, which are not shown here.

In this case the rolls 17 are protected by a metallic shield 19 arranged in segments (FIG. 1), while the device 10 according to the invention is protected by screens, which are not shown here but include suitable entry doors.

The segments of the metallic shield 19 can slide on each other horizontally and vertically so as to provide full closure when the relative roll 17 is being processed or when the metallic shield 19 has to be opened if work has to be done on the roll 17.

The fact that the roll 17 at work is protected by a shield 19 enables the machine operator to work on the other rolls in conditions of complete safety.

We claim:

1. Multipurpose device for rolls of sections comprising:

a rotary turret winder able to bear rolls of sections produced with a hot or cold process and including a rotary support having its axis of rotation substantially vertical and supporting along a circumference at least two roll-holder reels with their axes of rotation substantially parallel to the axis of rotation of the rotary support, at least one upright fixed to said rotary support, each of said at least one upright supporting a straightening assembly for straightening sections unwound from one of said roll-holder reels, wherein said at least one upright is positioned on said rotary support in such a manner that each roll-holder reel can cooperate with a respective one of said at least one upright and wherein said straightening assembly can be positioned to be substantially on the same axis as a feed axis of a machine downstream by rotation of said rotary turret winder.

2. Device as claimed in claim 1, in which a shearing assembly is included and directly connected to the straightening assembly.

3. Device as claimed in claim 1, in which at least one drawing assembly is included and directly connected to the straightening assembly.

4. Device as claimed in claim 1, in which a linearization assembly is included and directly connected to the straightening assembly.

5. Device as claimed in claim 1, in which an assembly to measure straightened lengths is included and directly connected to the straightening assembly.

6. Device as claimed in claim 1, wherein said sections are round bars.

7. Device as claimed in claim 1, wherein four roll-holder reels are provided equally distributed along said circumference of said rotary support and wherein three uprights are fixed to said rotary support and distributed along said circumference at an outward position in relation to said four roll-holder reels, each of said three uprights being distributed between two of said four roll-holder reels such that three of said roll-holder reels cooperate with respective straightening assemblies of said three uprights while the remaining one of said four roll-holder reels is free to be changed.

* * * * *